United States Patent [19]

Pedone

[11] 4,176,035

[45] Nov. 27, 1979

[54] INSTALLATION FOR THE PRODUCTION OF A COPPER FOIL INTENDED TO BE APPLIED TO A DIELECTRIC SUBSTRATE

[75] Inventor: Antonio Pedone, Tournai, Belgium

[73] Assignee: Societe dite Coppertron S.A., Tournai, Belgium

[21] Appl. No.: 903,120

[22] Filed: May 5, 1978

[30] Foreign Application Priority Data

May 10, 1977 [BE] Belgium ..... 854450

[51] Int. Cl.[2] ..... C25D 17/00; C25D 5/10; C25D 3/38

[52] U.S. Cl. ..... 204/205; 204/202; 204/206; 204/211; 204/41; 204/52 R

[58] Field of Search ..... 204/13, 202–209, 204/211, DIG. 7, 28

[56] References Cited

U.S. PATENT DOCUMENTS

| | | | |
|---|---|---|---|
| 2,165,326 | 7/1939 | Yerger et al. | 204/211 |
| 2,473,918 | 6/1949 | Stoltz et al. | 204/211 |
| 3,799,861 | 3/1974 | Pietro | 204/279 |

*Primary Examiner*—F. C. Edmundson
*Attorney, Agent, or Firm*—Fisher, Christen & Sabol

[57] ABSTRACT

The invention relates to an installation for the production of copper foils intended to be applied in particular to substrates of plastic material, comprising, inside a first electrolytic tank, an endless belt made of electrically conducting material, rotating continuously and having its lower part immersed in the electrolytic solution, wherein the formation of the electrolytic copper layer and, simultaneously, the desired structural formation of the superficial layer of the copper foil take place in this first tank and in one electrolytic solution.

4 Claims, 1 Drawing Figure

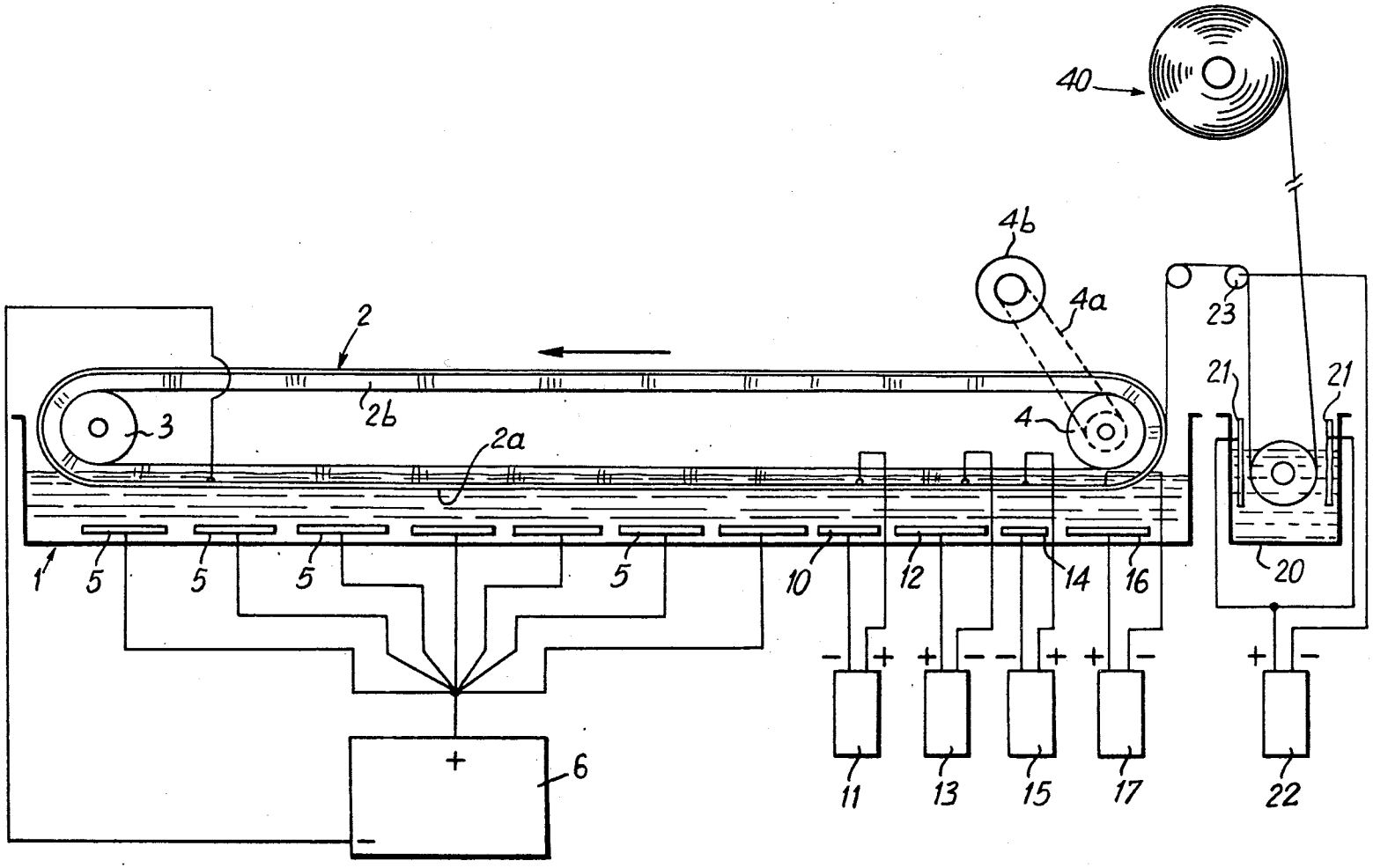
40
4b
4a
4
21
23
21
20
22
16
17
14
15
12
13
10
11
5
5
5
5
2a
2b
2
3
1
6

INSTALLATION FOR THE PRODUCTION OF A COPPER FOIL INTENDED TO BE APPLIED TO A DIELECTRIC SUBSTRATE

The present invention relates to an installation for the production of copper foils intended to be applied, in particular, to dielectric materials.

As is known at present, copper foils which are applied to substrates made of plastic material, for example for making printed circuits and the like, are subjected to different treatments aiming both at increasing the adhesion between the copper foil and the substrate and at preventing the catalytic reaction subsequently occuring between the copper and the dielectric material and in addition at preventing the "pollution" of the plastic matter due to detachment of the copper or copper oxide in the nodularisation treatments adapted to increase adhesion.

To prevent the catalytic action between the copper and the dielectric material, the manufacturers of electrical conductors have always adopted the solution of interposing a layer of metal, compatible with copper, for example tin, zinc, gold, silver, nickel, cadmium and the like, with the result that there is no direct contact between copper and plastic material, but just with the intermediate layer of metal. For producing the copper foils in question, installations are presently used which are extremely expensive and complex, comprising a plurality of machining stations both for executing the desired conformation of the surface of the copper and for applying the above-mentioned superficial layers.

Specific examples of the prior art known to the applicant comprise the applicant's prior U.S. Pat. No. 3,368,959, and a process described in the West German publication METALL dated Nov. 11, 1966, page 1210 and the accompanying FIG. 6.

Consequently, production is very slow, as it is necessary to transfer the copper foil to the following machining phases which generally take place in electrolytic tanks containing different electrolytic solutions.

Furthermore, the installations of known type are very bulky and, due to their fragmentary character, require a series of checks.

It is precisely an object of the present invention to eliminate the above-mentioned drawbacks by providing an installation for producing copper foils designed so as to allow the carrying out, in one electro-formation and in continuous succession, of all the operations necessary for obtaining the desired copper foils.

It is another object of the present invention to provide an installation in which all the operations may virtually be carried out in one unit, this offering the advantage of reducing the general bulk of the installation and in addition, of considerably simplifying the necessary checks in the installation.

Finally, the last object of the present invention is to produce an installation of simple structure, not requiring particular maintenance and allowing the hourly production to be increased, this naturally having positive effects on the production costs.

These, and other objects which will appear hereinafter, are attained in an installation for manufacturing copper foils intended to be applied in particular to substrates of plastics material, comprising, inside a first electrolytic tank, an endless belt made of electrically conducting material, which turns continuously and the lower part of which is immersed in the electrolytic solution, wherein the formation of the electrolytic copper layer and the subsequent structural modification of the superficial layer of the copper foil take place in this first tank and in one electrytic solution only.

The invention will be more readily understood on reading the following description with reference to the accompanying drawings, in which;

The single FIGURE schematically illustrates an installation according to the invention.

Referring now to the FIGURE, the installation for manufacturing copper foils according to the invention comprises a first electrolytic tank 1 inside which rotates an endless belt 2, made of electrically conductive material. The belt 2 is supported and driven by an idle roller 3 and a drive roller 4 which, via a chain **4*a*, is connected to a motor reduction unit 4*b*; in addition, the belt 2 is preferably made of stainless steel and its outer surface is perfectly smooth. The belt 2 presents on its edges a rubber edge 2*b*** whose function is to maintain the inner surface of the belt dry even during its passage in the electrolytic solution.

The lower part **2*a* of said belt 2 passes in the electrolytic solution which is contained in the first electrolytic tank 1**.

In the initial portion of said lower part **2*a*, with respect to the direction of movement of said belt 2 is provided a first series of plates located opposite said lower part 2*a* and which are parallel to one another and disposed transversely with respect to the path of said belt 2**.

These plates 5, which act as anode, are connected to the positive pole of a first source of supply 6, whilst the negative pole of the source of supply 6 is electrically connected to the lower part **2*a* of the belt 2**.

Downstream of this first series of plates 5 is provided a second series of plates which alternately have a reversed polarity; more precisely, at the end of the first series of plates 5 is provided a first plate 10 having a reversed polarity with respect to plates 5 and which is connected to the negative pole of a second source of supply 11, the positive pole of which is electrically connected to the lower part **2*a***.

Downstream of the said first plate 10 is provided a second series of plates 12 whose polarities coincide with the plates 5 of the first series and are contrary with respect to the polarity of plate 10 which precedes it; the second series of plates 12 is electrically connected to the positive pole of a third source of supply 13, the negative pole of which is electrically connected to the lower part **2*a* of the belt 2. Downstream of the second series of plates 12 is provided a third plate 14 whose polarity coincides with the first plate 10 and is reversed with respect to the second series of plates 12 and which is electrically connected to the negative pole of a fourth source of supply 15, the positive pole of which is electrically connected to the lower part 2*a***.

Downstream of the third plate 14 is provided a fourth series of plates 16 which has the same polarity as the first series of plates and as the second series of plates 12 and which is electrically connected to the positive pole of a fifth source of supply 17 having its negative pole electrically connected to the lower part **2*a*. Downstream of the first electrolytic tank 1 is provided a second electrolytic tank 20 which has for its function to apply on the layer of copper formed on the belt 2 a thin layer of metal chemically compatible with copper; this metallic layer is very thin, so as not to modify the structural conformation taken by the layer of copper in the electroformation phase in the first electrolytic tank 1**.

In the second electrolytic tank 20 are provided vertical plates 21 which are connected to the positive pole of a sixth source of supply 22 which has its negative pole connected to the cathodic roller 23 on which winds the layer of copper formed previously for application of the metallic layer.

It should also be added that inside the electrolytic tanks may be provided stirring devices for maintaining the electrolytic solution in movement. The installation according to the invention functions as follows:

At the beginning, the belt 2 which is immersed in the electrolytic tank 1, further to the electrical connection described hereinabove, acts as cathodic support and is consequently bombarded by a myriad of tiny particles of copper; as the cathodic support continues its path opposite the first series of plates 5, the particles increase in dimensions so as to form a copper foil whose surface is rough, comparable to numerous rounded masses placed side by side.

When the belt arrives opposite the first plate 10, a sudden reversal of polarity is produced, so that the particles of copper suddenly cease their constant growth. Thereafter, the rounded masses, obtained as described previously, arrive opposite the second series of plates 12 where they are again bombarded by another myriad of particles so that they lose their smooth rounded appearance to assume a stippled or ramified appearance.

By suitably acting on the densities of currents with more or less strong stirring of the electrolytic solution, it is possible to obtain all the desired superficial structures directly in the copper production phase.

The layer of copper thus treated is virtually ready for treatment; however, if it is desired to modify the superficial structure of the copper further, it is possible to subject the layer of copper again to a sudden interruption of growth upon its passage opposite the third plate 14 and to a subsequent bombardment of particles opposite the fourth series of plates 16.

At this moment, once the copper foil having the desired structure is obtained, in order better to present or preserve the layer of copper, said latter is introduced into a second electrolytic tank 20 where a thin layer of metal which may comprise nickel, zinc, cadmium or other equivalent materials is applied to the layer of copper, using the conventional operations known in the galvanic art.

The coating of zinc, nickel, cadmium or the like is preferably produced so as to obtain a very thin layer to avoid altering the structure and conformation of the sub-jacent copper layer obtained by bombardment of the particles in the first electrolytic tank.

On the basis of the description, it is seen how the invention attains the proposed objects. It is emphasized in particular that the installation functions continuously and does not require that the prefabricated copper reel be transported into another type of installation for the following treatments, as in the installations of known type, this involving an increase in manpower and installing costs.

Another important advantage of the installation according to the invention resides in the fact that it produces the copper foil having, according to the use for which it is intended, the desired superficial structure in the same phase of electroformation of the copper and in the same bath.

It should also be emphasized that it is possible to obtain the desired superficial structure during the same phase of electroformation of the copper foil, without having to resort to subsequent baths which firstly electrically deposit a layer of powdered copper or copper oxide which is non-integrated and which, in order to be able to fix this unsuitable layer, are obliged to enclose it in a layer of integrated copper.

It should also be added that the electroformed film of copper having the desired structure, before being wound on the roller schematically indicated at 40 in the FIGURE, may be passed into a second galvanic bath different from the first where it may be galvanically coated with a protective layer of any other metal compatible with copper, following the normal instructions described in all electro-plating manuals relative to galvanic protective coatings.

Another important feature of the installation according to the invention resides in the fact that all the sources of supply mentioned, which are constituted by rectifiers, are phased adequately with respect to one another so as to be simultaneously connected, even with different polarities, to the lower part 2*a* of the belt 2.

The invention is not limited to the embodiment which has been described hereinabove but may undergo modifications without departing from the scope thereof. The materials used as well as the dimensions and forms may be varied, according to requirements.

What we claim is:

1. An installation for the production of copper foils intended to be applied particularly to substrates of plastic material, comprising;

a first tank for containing an electrolytic solution therein;

an endless belt made of electrically conductive material mounted in said tank for continuous movement of the lower portion of the belt in one direction including means for immersing the lower surface of said lower portion in an electrolyte, contained in said tank a first series of plates to be immersed in said electrolyte spaced from an upstream section of said lower portion of said endless belt, said series of plates comprising anodes and said endless belt comprising a cathode when subjected to an electrical potential having the appropriate polarity;

a second series of plates to be immersed in said electrolyte spaced from said belt and successively spaced downstream from said first series of plates;

means to apply to each of said second series of plates and to the respective portions of said belt adjacent each of said plates direct current potentials of respective alternate polarities whereby a layer of copper electrolytically deposited on said belt will be subjected to sudden interruptions of deposition;

and a second tank disposed downstream of said first tank for containing another electrolytic solution for depositing on the layer of copper from said dirst tank a thin layer of metal chemically compatible with said copper and with a plastic material with which the copper layer is to be associated.

2. An installation as claimed in claim 1, wherein said first series of plates and each of the plates of said second series of plates are supplied by independent sources.

3. An installation as claimed in claim 2, wherein said sources of supply comprise rectifiers suitably phased so that the different polarities of the various supply sources are applied to the inner lower part of said belt.

4. An installation as claimed claim 1, wherein the plates of said first series and the second series are parallel to one another and disposed transversely with respect to the path of the lower part of said belt.

* * * * *